US010940968B2

(12) United States Patent
Liu et al.

(10) Patent No.: US 10,940,968 B2
(45) Date of Patent: Mar. 9, 2021

(54) BANKNOTE-SORTING PRODUCTION LINE AND DEVICE THEREOF FOR BANKNOTE-BUNDLE STAMPING AND CODE SPRAYING

(71) Applicant: GRG BANKING EQUIPMENT CO., LTD., Guangzhou (CN)

(72) Inventors: Heng Liu, Guangzhou (CN); Maoling Chen, Guangzhou (CN); Heng Zhang, Guangzhou (CN); Shang Yin, Guangzhou (CN); Yuxuan Xie, Guangzhou (CN)

(73) Assignee: GRG BANKING EQUIPMENT CO., LTD., Guangzhou (CN)

( * ) Notice: Subject to any disclaimer, the term of this patent is extended or adjusted under 35 U.S.C. 154(b) by 256 days.

(21) Appl. No.: 16/078,022

(22) PCT Filed: Mar. 23, 2017

(86) PCT No.: PCT/CN2017/077822
§ 371 (c)(1),
(2) Date: Aug. 21, 2018

(87) PCT Pub. No.: WO2017/162186
PCT Pub. Date: Sep. 28, 2017

(65) Prior Publication Data

US 2019/0077534 A1 Mar. 14, 2019

(30) Foreign Application Priority Data

Mar. 24, 2016 (CN) ..... 201610179951.9

(51) Int. Cl.
*B65B 61/26* (2006.01)
*B65B 13/18* (2006.01)
(Continued)

(52) U.S. Cl.
CPC ..... *B65B 61/26* (2013.01); *B41J 3/283* (2013.01); *B65B 13/18* (2013.01); *B65B 25/14* (2013.01);
(Continued)

(58) Field of Classification Search
CPC ..... B65B 61/26; B65B 13/18; B65B 25/14; B65B 35/50; B65B 61/02; B65B 61/025;
(Continued)

(56) References Cited

U.S. PATENT DOCUMENTS 4,334,619 A * 6/1982 Horino ..... G06M 7/06 209/551
4,624,359 A * 11/1986 Gross ..... B65H 5/00 198/369.1
(Continued)

FOREIGN PATENT DOCUMENTS

CN 102825927 A 12/2012
CN 103871156 A 6/2014
(Continued)

OTHER PUBLICATIONS

CN First Office Action with Search Report dated Sep. 5, 2017 in the corresponding CN application (application No. 201610179951.9).
(Continued)

*Primary Examiner* — Nathaniel C Chukwurah
*Assistant Examiner* — Mobeen Ahmed
(74) *Attorney, Agent, or Firm* — Kilpatrick Townsend & Stockton, LLP

(57) ABSTRACT

Provided are a banknote-sorting production line and device thereof for banknote-bundle stamping and code-spraying, comprising a bundle stamping apparatus, a bundle code-spraying apparatus, and a banknote-supporting platform provided with a banknote inlet and a banknote outlet; the bundle stamping apparatus comprises a conveyor belt and a
(Continued)

stamping mechanism located above the conveyor belt; the bundle code-spraying apparatus comprises a banknote-pushing mechanism and a code sprayer located directly above the banknote-supporting platform; the side of the banknote-supporting platform that is adjacent to the banknote inlet is provided with a gap matching the shape of the conveyor belt; the outlet end of the conveyor belt extends into the gap; the banknote-pushing mechanism comprises a banknote-pushing plate and a first drive mechanism that drives the banknote-pushing plate by moving reciprocatingly from the banknote-inlet side to the banknote-outlet side.

10 Claims, 10 Drawing Sheets

(51) Int. Cl.

| | |
|---|---|
| ***G07D 11/00*** | (2019.01) |
| ***B65B 61/02*** | (2006.01) |
| ***B65B 25/14*** | (2006.01) |
| ***B41J 3/28*** | (2006.01) |
| ***B65B 35/50*** | (2006.01) |
| ***G07D 11/50*** | (2019.01) |
| *G07D 11/36* | (2019.01) |
| *G07D 11/20* | (2019.01) |
| *G07D 11/30* | (2019.01) |
| *G07D 11/34* | (2019.01) |
| *B65B 61/00* | (2006.01) |
| *G07D 11/24* | (2019.01) |
| *G07D 11/32* | (2019.01) |

(52) U.S. Cl.
CPC ..... *B65B 35/50* (2013.01); *B65B 61/025* (2013.01); *G07D 11/50* (2019.01); *B41J 3/28* (2013.01); *B65B 61/007* (2013.01); *B65B 61/02* (2013.01); *B65H 2301/4314* (2013.01); *B65H 2701/1912* (2013.01); *G07D 11/00* (2013.01); *G07D 11/20* (2019.01); *G07D 11/24* (2019.01); *G07D 11/30* (2019.01); *G07D 11/32* (2019.01); *G07D 11/34* (2019.01); *G07D 11/36* (2019.01)

(58) Field of Classification Search
CPC ..... B65B 61/07; G07D 11/50; G07D 11/00; G07D 11/20; G07D 11/24; G07D 11/30; G07D 11/32; G07D 11/34; G07D 11/36; B65H 2301/4314; B65H 2701/1912; B41J 3/283; B41J 3/28
USPC ..... 53/131.2, 131.4, 495, 540; 101/407.1, 101/474; 400/629, 635; 194/206, 207; 235/379; 209/534; 198/468.8, 456, 198/369.6, 369.1, 817
See application file for complete search history.

(56) References Cited

U.S. PATENT DOCUMENTS

| | | | | |
|---|---|---|---|---|
| 5,749,456 | A * | 5/1998 | Logie | B65H 31/3027 198/626.5 |
| 7,367,169 | B2 | 5/2008 | Katsumata | |
| 9,156,647 | B2 * | 10/2015 | Sauer | B65H 83/02 |
| 9,607,463 | B2 * | 3/2017 | Cai | G07D 11/14 |
| 2002/0088690 | A1 * | 7/2002 | Christofferson | B65H 29/18 198/644 |
| 2004/0003980 | A1 * | 1/2004 | Hallowell | B65B 27/08 194/206 |
| 2006/0283341 | A1 * | 12/2006 | Otsuka | G07D 11/32 101/35 |
| 2009/0013653 | A1 * | 1/2009 | Sekiguchi | G07D 11/50 53/531 |
| 2009/0243181 | A1 * | 10/2009 | Sauer | B65H 33/16 270/58.08 |
| 2010/0271619 | A1 * | 10/2010 | Lohner | G07D 7/00 356/71 |
| 2011/0072987 | A1 * | 3/2011 | Nobuhara | G07D 11/50 100/7 |
| 2011/0155798 | A1 | 6/2011 | Pinchen et al. | |
| 2012/0279882 | A1 | 11/2012 | Prahm et al. | |
| 2014/0130450 | A1 * | 5/2014 | Uehara | B65B 61/26 53/128.1 |
| 2015/0203318 | A1 * | 7/2015 | Deng | B65H 31/02 271/83 |
| 2016/0167817 | A1 * | 6/2016 | Mitsusada | B65B 35/50 53/64 |
| 2017/0073095 | A1 * | 3/2017 | Kobayashi | B65B 27/08 |

FOREIGN PATENT DOCUMENTS

| | | | |
|---|---|---|---|
| CN | 103754438 | A | 12/2014 |
| CN | 104192337 | A | 12/2014 |
| CN | 104192376 | A | 12/2014 |
| CN | 104210711 | A | 12/2014 |
| CN | 204137364 | U | 2/2015 |
| CN | 204341457 | U | 5/2015 |
| CN | 104829326 | A | 8/2015 |
| CN | 105082780 | A | 11/2015 |
| CN | 105383729 | A | 3/2016 |
| EP | 2716553 | A1 | 4/2014 |
| EP | 2909037 | A1 | 8/2015 |
| JP | 9-159613 | A | 6/1997 |
| JP | 2005350074 | A | 12/2005 |
| RU | 2336571 | C2 | 10/2008 |
| RU | 2496695 | C2 | 10/2013 |
| WO | 2010103618 | A1 | 9/2010 |

OTHER PUBLICATIONS

Decision to Grant of Counterpart Russian Patent Application No. 2018126813.
International Search Report with written opinion dated Jul. 3, 2017 in the corresponding international application (application No. PCT/CN2017/077822).
Chile First Office Action dated Jul. 24, 2019 in the corresponding Chile application (application No. 201802008).

* cited by examiner

BANKNOTE-SORTING PRODUCTION LINE AND DEVICE THEREOF FOR BANKNOTE-BUNDLE STAMPING AND CODE SPRAYING

CROSS-REFERENCE TO RELATED APPLICATIONS

The present application is the national phase of International Application No. PCT/CN2017/077822, filed on Mar. 23, 2017, which claims priority to Chinese Application No. 201610179951.9, filed on Mar. 24, 2016, both of which are incorporated herein by reference in their entireties.

TECHNICAL FIELD

The present disclosure relates to the technical field of machinery and equipment for financial applications, in particular to a banknote-sorting production line and a device for banknote-bundle stamping and code-spraying thereof.

BACKGROUND

Both financial institutions and banknote manufacturing enterprises need to sort a plenty of banknotes, to bundle banknotes with a sorting and bundling integrated machine, and the bundled banknotes need to be printed with related information on their bundling bands, such like heading numbers. Currently, although sorting production lines can record heading numbers during the process of sorting banknotes, they are unstable and inefficient in that it will occur non-matching between records of heading numbers and packed banknotes after suspending and restarting of sorting when occurring malfunctions, which results in that the banknotes sorted by sorting production lines could not be used to refill ATMs directly and to track heading numbers accurately.

SUMMARY

A device for banknote-bundle stamping and code-spraying is provided, including a banknote-bundle stamping device, a banknote-bundle code-spraying device and a banknote-supporting platform provided with a banknote inlet and a banknote outlet, and the banknote-bundle stamping device include a conveyor belt and a stamping mechanism positioned above the conveyor belt, the banknote-bundle code-spraying device includes a banknote-pushing mechanism and a code sprayer positioned directly above the banknote-supporting platform, a side of the banknote-supporting platform that is adjacent to the banknote inlet is provided with a gap matching a shape of the conveyor belt, an outlet end of the conveyor belt extends into the gap, the banknote-pushing mechanism includes a banknote-pushing plate and a first drive mechanism adapted to drive the banknote-pushing plate to reciprocate from a banknote inlet side to a banknote outlet side, and the stamping mechanism includes a stamp and a second drive mechanism adapted to drive the stamp to move.

During operation, banknote bundles are conveyed by the conveyor belt to a stamping area where the second drive mechanism drives the stamp to move towards the banknote bundles and to stamp the bundling bands of the banknote bundles. The stamped banknote bundles move with the conveyor belt to the banknote-supporting platform where the first drive mechanism drives the banknote-pushing plate to move from a banknote inlet side to a banknote outlet side, and the code sprayer prints labels including information such as heading numbers, on the bundling bands of banknote bundles when the banknote bundles pass through the code sprayer. After the code-spraying is completed, the banknote-pushing plate pushes the banknote bundles to the banknote outlet of the banknote-supporting platform, to enter into a next sorting process. The device for banknote-bundle stamping and code-spraying can achieve automatic stamping and code-spraying of banknote bundles, with high operation efficiency. Each of banknote bundles has a stamped label and a printed label, so that the banknote information can be tracked accurately during the transfer process, to facilitate to refill ATMs with banknotes. For a sorting production line using the above device for banknote-bundle stamping and code-spraying, there is no condition where records of heading numbers do not match the packed banknotes after the sorting production line being restarted due to malfunctions, which improves the operation stability and the operation efficiency.

The following is a further explanation of the above technical solution.

Further, the banknote-bundle stamping device further includes a blocking mechanism positioned under the conveyor belt, the blocking mechanism includes a stopper and a third drive mechanism adapted to drive the stopper to extend out of the conveyor belt, and the conveyor belt is provided with an opening cooperated with the stopper. As banknote bundles enter the conveyor belt, the third drive mechanism drives the stopper to extend out of the conveyor belt, and the banknote bundles stop going forward when conveyed to the position of the stopper so as to position the banknote bundles, which improves the stamping accuracy.

Further, the banknote-bundle stamping device further includes a banknote stirring baffle and a banknote stirring mechanism positioned on both sides of the conveyor belt respectively in a conveying direction, and the banknote stirring mechanism includes a banknote stirring plate and a fourth drive mechanism adapted to drive the banknote stirring plate to move towards the banknote stirring baffle. After the banknote bundle has been positioned by the blocking mechanism for the first time, the conveyor belt stop moving, and then the third drive mechanism drives the stopper to move downwards to the underside of the conveyor belt. After the stopper has been retracted, the fourth drive mechanism drives the banknote stirring plate to push the banknote bundle to be in contact with the banknote stirring baffle to align the banknote bundle, so that the banknote bundle can be positioned for the second time, which further improves the stamping accuracy.

Further, the banknote-bundle stamping device further includes a banknote pressing mechanism positioned above the conveyor belt, and the banknote pressing mechanism includes a pressing plate and a fifth drive mechanism adapted to drive the pressing plate to move up and down. Before stamping the banknote bundle, the fifth drive mechanism drives the pressing plate to move downwards and to press the banknote bundle tight, and then the second drive mechanism drives the stamp to stamp the banknote bundle so as to avoid any blurred stamp caused by the movement of the banknote bundle during the stamping process, which further improves the stamping accuracy.

Further, a stamping mechanism and the pressing plate are fastened to a movable end of the fifth drive mechanism, the stamping mechanism includes two stamps arranged symmetrically, and moving tracks of the two stamps on the banknote-bundle stamping device are parallel to a conveying direction of the conveyor belt. During stamping, the fifth drive mechanism drives both the stamping mechanism and the pressing plate to move downwards, and after the pressing plate presses the banknote bundle tight, the stamping mechanism drives the two stamps to move towards each other in opposite directions, and to stamp both sides of the bundling band of the banknote bundle respectively.

Further, the banknote-pushing plate is provided with at least one protuberance protruding towards a banknote-supporting platform side, and the banknote-supporting platform is provided with a gap cooperated with the protuberance. The cooperation of the protuberance and the gap prevents the presence of any space between the banknote-pushing plate and the banknote-supporting platform, to secure that the banknote bundle can be pushed to the code sprayer completely.

Further, the banknote-bundle code-spraying device further includes a mounting bracket positioned directly above the banknote-supporting platform, a mounting platform positioned directly under the banknote-supporting platform and a seventh drive mechanism adapted to drive the banknote-supporting platform to move up and down, the mounting bracket is provided with the banknote-pushing mechanism and the code sprayer, and the mounting platform is provided with the conveyor belt. After the conveyor belt brings the banknote bundle into the banknote-supporting platform, the conveyor belt stop moving. The seventh drive mechanism drives the banknote-supporting platform to move upwards, and the banknote-supporting platform stops moving when the banknote-supporting platform moves to the underside of the banknote-pushing plate. The first drive mechanism drives the pushing plate to move the banknote bundle towards the banknote outlet side. The whole structure is designed flexibly and intelligently, which uses the cooperation of the gap of the banknote-supporting platform with the conveyor belt and the banknote-pushing plate sufficiently to prevent interference between the conveyor belt and the banknote-pushing plate during operation.

Further, the mounting platform is provided with a blocking rod, and the banknote-supporting platform is provided with an opening hole cooperated with the blocking rod. When the banknote-supporting platform is positioned on the mounting platform, the blocking rod protrudes through the opening hole precisely, and when the banknote bundle is moved to the banknote-supporting platform with the conveyor belt and the banknote bundle is moved to the position of the blocking rod, the blocking rod aligns the banknote bundle. After the banknote bundle is aligned, the banknote-supporting platform moves upwards to the underside of the banknote-pushing plate, and the banknote-pushing plate pushes the banknote bundle to the banknote outlet of the banknote-supporting platform, so as to secure the accurate positioning of the code-spraying position of banknote bundle. The whole structure is designed flexibly and intelligently to prevent interference between the blocking rod and the banknote-pushing plate during operation.

Further, the seventh drive mechanism includes a lifting guide rod slidably connected to the banknote-supporting platform, a lifting belt arranged in a vertical direction and connected to the banknote-supporting platform, and a driving wheel adapted to drive the lifting belt to rotate. The banknote-supporting platform is driven to move up and down with the lifting belt, and the lifting guide rod is slidably connected to the banknote-supporting platform, so that it allows the banknote-supporting platform to be more stable during the process of the up-down movement.

The present disclosure further provides a banknote-sorting production line, including a sorting and bundling integrated machine, a device for banknote-bundle stamping and code-spraying, a conveyor main line provided with a first code-scanning mechanism adapted to identify stamped and printed labels, a palletizer, and a plastic packaging machine provided with a printing mechanism and a second code-scanning mechanism adapted to identify the stamped and printed labels, all of which are connected cooperatively and sequentially.

The sorting and bundling integrated machine may sort banknotes into damaged banknotes, banknotes for ATMs, circulating banknotes, suspicious banknotes and such like, and bundle a specified number of banknotes according to the configuration. The bundled banknote bundles may be conveyed to a conveying channel. The banknote bundles may be conveyed to the conveyor main line after being stamped and printed with the device for banknote-bundle stamping and code-spraying. The first code-scanning mechanism may scan the stamped and printed labels into the system during the conveying process of the conveyor main line. The conveyor main line may convey the banknote bundles to the palletizer, which palletizes a specified number of banknote bundles and transfers the palletized banknote bundles to the plastic packaging machine. During plastic packaging for a bale of banknote bundles by the plastic packaging machine, the second code-scanning mechanism of the plastic packaging machine may scan the stamped and printed labels on each bundle of banknotes of the bale of banknote bundles, and generate a label according to the scanning result to print on the label of the banknote bale. It is ultimately possible to find information such like heading numbers of a whole banknote bale or one certain banknote by identifying the labels on the banknote bales, achieving the precise tracking of information such like heading numbers of banknotes to facilitate to refill ATMs with banknotes.

During operation of the device for banknote-bundle stamping and code-spraying according to the present disclosure, banknote bundle are conveyed by the conveyor belt to a stamping area where the second drive mechanism drives the stamp to move towards the banknote bundles and to stamp the bundling bands of the banknote bundles. The stamped banknote bundles move with the conveyor belt to the banknote-supporting platform where the first drive mechanism drives the banknote-pushing plate to move from a banknote inlet side to a banknote outlet side, and the code sprayer prints labels including information such like heading numbers, on the bundling bands of banknote bundles when the banknote bundles pass through the code sprayer. After the code-spraying is completed, the banknote-pushing plate pushes the banknote bundles to the banknote outlet of the banknote-supporting platform, to enter into a next sorting process. The device for banknote-bundle stamping and code-spraying can achieve automatic stamping and code-spraying of banknote bundles, with high operation efficiency. Each of banknote bundles has a stamped label and a printed label, so that the banknote information can be tracked accurately during the transfer process, to facilitate to refill ATMs with banknotes. For a sorting production line using the above device for banknote-bundle stamping and code-spraying, there is no condition where records of heading numbers do not match the packed banknotes after the sorting production line being restarted due to malfunctions, which improves the operation stability and the operation efficiency.

DESCRIPTION OF THE REFERENCE NUMERALS IN THE DRAWINGS

Figure 1:
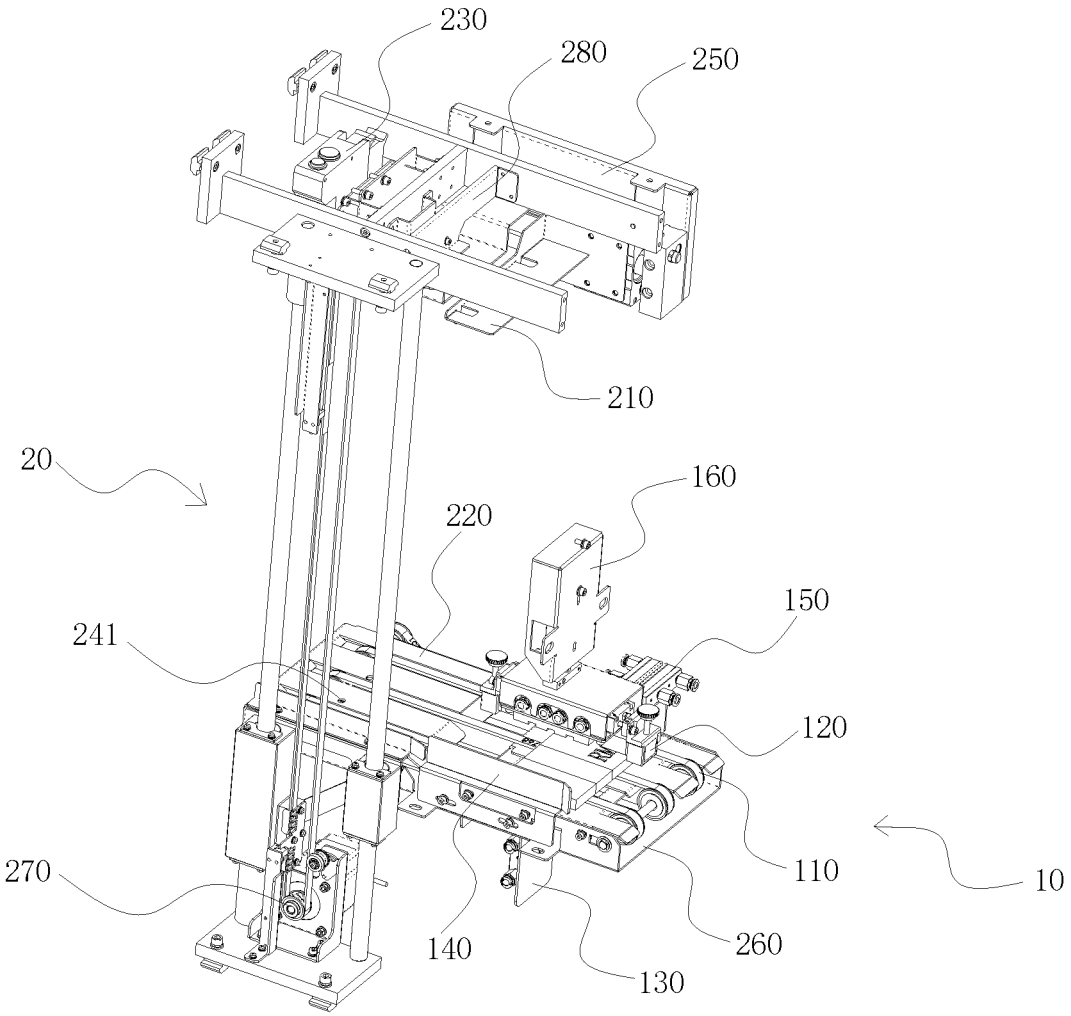
FIG. 1 is a schematic diagram illustrating a first operating state of a device for banknote-bundle stamping and code-spraying according to an embodiment of the present disclosure.

10. banknote-bundle stamping device; 110. conveyor belt; 111. opening; 120. stamping mechanism; 121. stamp; 122. second drive mechanism; 1221. driving rod; 1222. stamp fastener; 1223. pressing knob; 130. blocking mechanism; 131. stopper; 132. third drive mechanism; 140. banknote stirring baffle; 150. banknote stirring mechanism; 151. banknote stirring plate; 152. fourth drive mechanism; 160. banknote pressing mechanism; 161. pressing plate; 162. fifth drive mechanism; 20. banknote-bundle code-spraying device; 210. banknote-pushing mechanism; 211. banknote-pushing plate; 211. protuberance; 212. first drive mechanism; 220. banknote-supporting platform; 221. banknote inlet; 222. banknote outlet; 223. gap; 224. opening hole; 230. code sprayer; 241. blocking rod; 250. mounting bracket; 260. mounting platform; 270. seventh drive mechanism; 271. lifting guide rod; 272. lifting belt; 273. driving wheel; 280. banknote-supporting platform upper limit sensor; 30. sorting and bundling integrated machine; 40. conveyor main line; 50. palletizer; 60. plastic packaging machine; 70. banknote outgoing line; 80. pedestal; 90. environmental worktable; and 100. frame.

DETAILED DESCRIPTION OF THE EMBODIMENTS

The embodiments of the present disclosure will be detailed with reference to the accompanying drawings.

As shown in FIGS. 1 to 4, a device for banknote-bundle stamping and code-spraying includes a banknote-bundle stamping device 10, a banknote-bundle code-spraying device 20 and a banknote-supporting platform 220 provided with a banknote inlet 221 and a banknote outlet 222. The banknote-bundle stamping device 10 includes a conveyor belt 110 and a stamping mechanism 120 positioned above the conveyor belt 110. The banknote-bundle code-spraying device 20 includes a banknote-pushing mechanism 210 and a code sprayer 230 positioned directly above the banknote-supporting platform 22. A side of the banknote-supporting platform 220 adjacent to the banknote inlet 221 is provided with a gap 223 matching a shape of the conveyor belt 110. An outlet end of the conveyor belt 110 extends into the gap 223, and the gap 223 is lower than the conveying surface of the conveyor belt 110. The banknote-pushing mechanism 210 includes a banknote-pushing plate 211 and a first drive mechanism 212 adapted to drive the banknote-pushing plate 211 to reciprocate from a side with the banknote inlet 221 to a side with the banknote outlet 222. The stamping mechanism 120 includes a stamp 121 and a second drive mechanism 122 adapted to drive the stamp 121 to move.

During operation, banknote bundles are conveyed by the conveyor belt 110 to a stamping area with where the second drive mechanism 122 drives the stamp 121 to move towards the banknote bundles and to stamp the bundling bands of the banknote bundles. The stamp 121 has information about banknotes in banknote bundles or information about sorting workers. The stamped banknote bundles move with the conveyor belt 100 to the banknote-supporting platform 220 where the first drive mechanism 212 drives the banknote-pushing plate 211 to move from a side with the banknote inlet 221 to a side with the banknote outlet 222. The code sprayer 230 prints labels including information such like heading numbers, on the bundling bands of the banknote bundles when the banknote bundles pass through the code sprayer 230. After the code-spraying is completed, the banknote-pushing plate 211 pushes the banknote bundles to the banknote outlet 222 of the banknote-supporting platform 220, to enter into a next sorting process. The device for banknote-bundle stamping and code-spraying can achieve automatic stamping and code-spraying of banknote bundles, with high operation efficiency. Each of banknote bundles has a stamped label and a printed label, so that the banknote information can be tracked accurately during the transfer process, to facilitate to refill ATMs with banknotes. For a sorting production line using the above device for banknote-bundle stamping and code-spraying, there is no condition where records of heading numbers do not match the packed banknotes after the sorting production line being restarted due to malfunctions, which improves the operation stability and the operation efficiency.

In this embodiment, the device for banknote-bundle stamping and code-spraying further includes a controller (not shown) electrically connected to the first drive mechanism 212 and the second drive mechanism 122, and the stamping mechanism 120 includes a stamping position sensor (not shown) electrically connected to the controller. After the banknote bundle is conveyed to the stamping area, the stamping position sensor send the collected information to the controller, and the controller controls the second drive mechanism 122 to act to stamp the banknote bundle, which makes the control more precise and the operation more efficient.

As shown in FIG. 1, and FIGS. 4 to 6, the banknote-bundle stamping device 10 further includes a blocking mechanism 130 positioned under the conveyor belt 110. The blocking mechanism 130 includes a stopper 131 and a third drive mechanism 132 adapted to drive the stopper 131 to extend out of the conveyor belt 110. The conveyor belt 110 is provided with an opening 111 cooperated with the stopper 131. As banknote bundles enter the conveyor belt 110, the third drive mechanism 132 drives the stopper 131 to extend out of the conveyor belt 110, and the banknote bundles stop going forward when conveyed to the position of the stopper 131 so as to position the banknote bundles, which improves the stamping accuracy.

Figure 7:
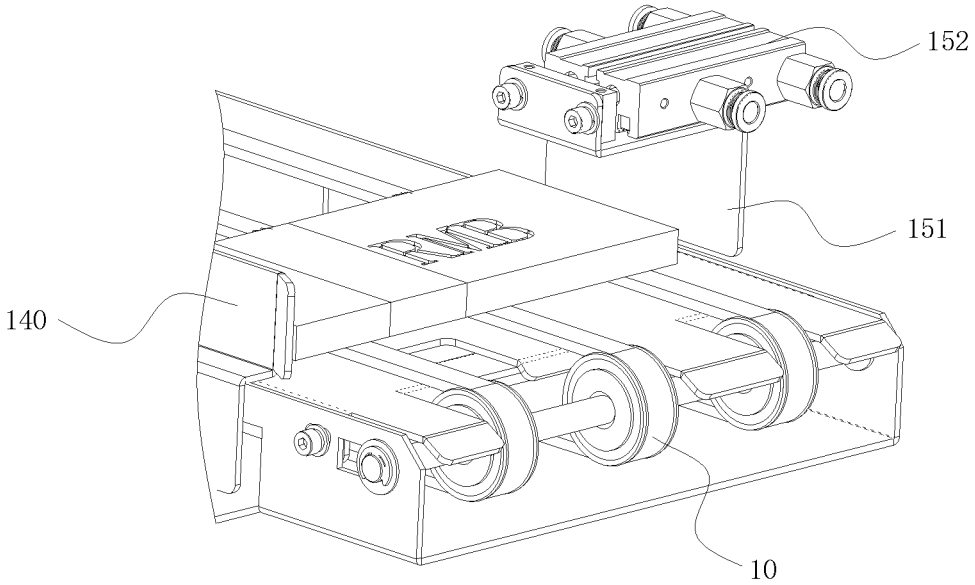
FIG. 7 is a structural schematic diagram illustrating a banknote stirring mechanism according to an embodiment of the present disclosure.

As shown in FIGS. 1 and 7, the banknote-bundle stamping device 10 further includes a banknote stirring baffle 140 and a banknote stirring mechanism 150 positioned on the both sides of the conveyor belt 110 respectively in a conveying direction. The banknote stirring mechanism 150 includes a banknote stirring plate 151 and a fourth drive mechanism 152 adapted to drive the banknote stirring plate 151 to move towards the banknote stirring baffle 140. After the banknote bundle has been positioned by the blocking mechanism 130 for the first time, the conveyor belt 110 stop moving, and then the third drive mechanism 132 drives the stopper 131 to move downwards to the underside of the conveyor belt 110. After the stopper 131 has been retracted, the fourth drive mechanism 152 drives the banknote stirring plate 151 to push banknote bundle to be in contact with the banknote stirring baffle 140 to align the banknote bundle, so that the banknote bundle can be positioned for the second time, which further improves the stamping accuracy.

In this embodiment, as shown in FIG. 7, the banknote stirring plate 151 is formed by a metal plate which is bent and processed to be in a shape of a character "7". The fourth drive mechanism 152 is fastened to the banknote stirring plate 151 so as to fasten the fourth drive mechanism 152 above the conveyor belt 110, which reduces the width of the entire device. The banknote stirring plate 151 may also be configured in other shapes according to actual needs.

Figure 8:
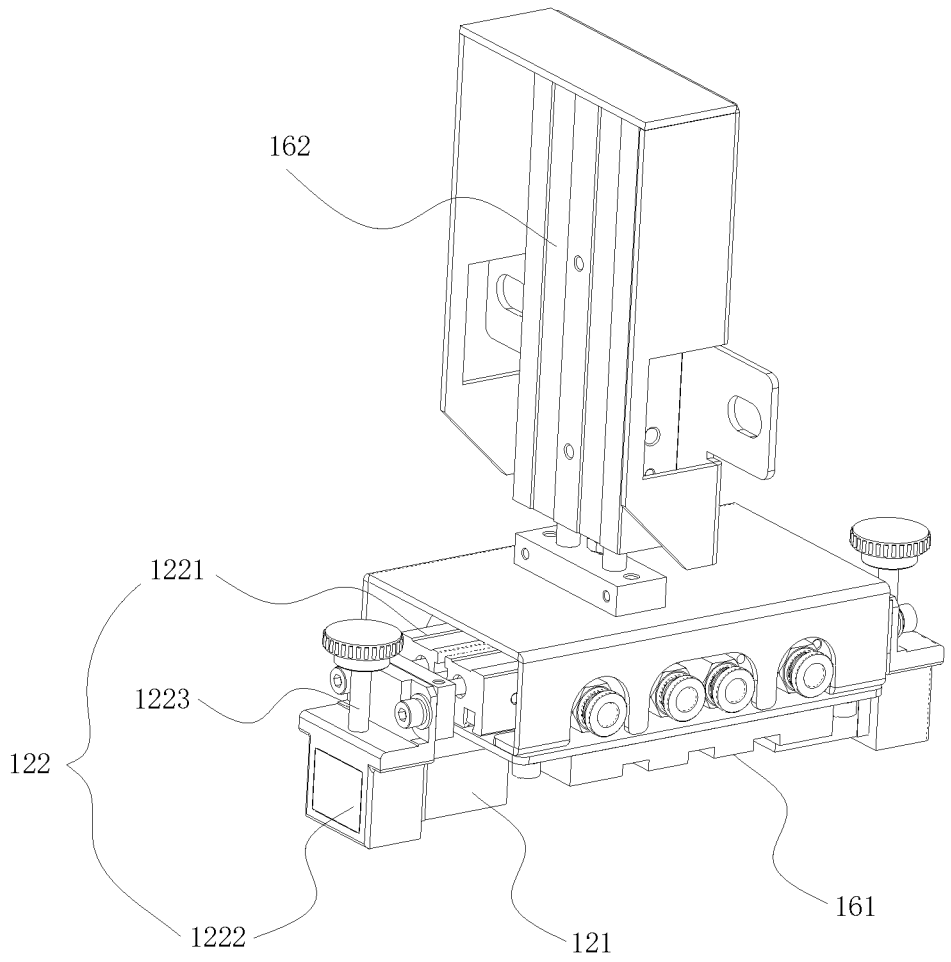
FIG. 8 is a structural schematic diagram illustrating a stamping mechanism and a banknote pressing mechanism according to embodiment of the present disclosure.
Figure 9:
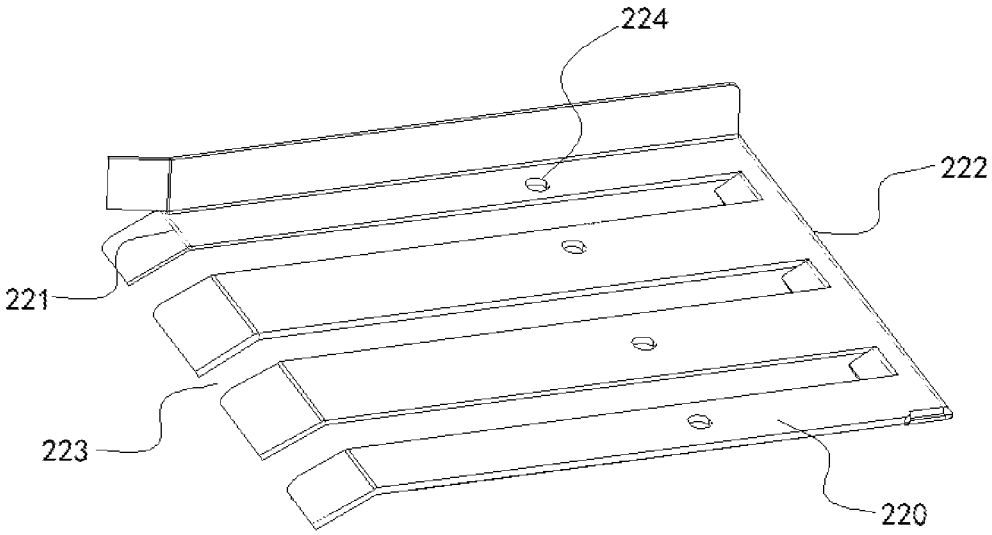
FIG. 9 is a structural schematic diagram illustrating a banknote-supporting platform according to an embodiment of the present disclosure.

As shown in FIGS. 1 and 8, the banknote-bundle stamping device 10 further includes a banknote pressing mechanism 160 positioned above the conveyor belt 110. The banknote pressing mechanism 160 includes a pressing plate 161 and a fifth drive mechanism 162 adapted to drive the pressing plate 161 to move up and down. Before stamping banknote bundles, the fifth drive mechanism 162 drives the pressing plate 161 to move downwards and to press the banknote bundles tight, and then the second drive mechanism 122 drives the stamp 121 to stamp the banknote bundles so as to avoid any blurred stamp caused by the movement of the banknote bundle during the stamping process, which further improves the stamping accuracy.

As shown in FIGS. 1 and 8, the stamping mechanism 120 and the pressing plate 161 are fastened to a movable end of the fifth drive mechanism 162, the stamping mechanism 120 includes two stamps 121 arranged symmetrically, and moving tracks of the two stamps 121 on the banknote-bundle stamping device 10 are parallel to a conveying direction of the conveyor belt 110. During stamping, the fifth drive mechanism 162 drives both the stamping mechanism 120 and the pressing plate 161 to move downwards, and after the pressing plate 161 presses the banknote bundle tight, the stamping mechanism 120 drives the two stamps 121 to to move towards each other in opposite directions, and to stamp both sides of bundling band of banknote bundle. After stamping is completed, the stamping mechanism 120 drives the two stamps 121 to extend outwards, and the stamping mechanism 120 is retracted. The stamping mechanism 120 may also drive the stamps 121 to perform movements in other directions according to the positions where banknote bundle need to be stamped.

As shown in FIG. 8, the second drive mechanism 122 includes driving rods 1221, stamp fasteners 1222 and pressing knobs 1223 corresponding to the stamps 121 respectively. The stamps 121 are removably connected to the respective driving rods 1221 through the respective stamp fasteners 1222 and pressing knobs 1223. It is facilitated to mount and remove the stamp, which is convenient for daily use. One stamp 121 or two stamps 121 may be used according to actual needs, which is more flexible and convenient. The stamp 121 may also be connected to the second drive mechanism 122 in other manners according to actual needs.

The banknote-bundle stamping device 10 also includes a banknote entering sensor (not shown), electrically connected to the controller and positioned at the entrance to the conveyor belt 100. During operation of the banknote-bundle stamping device 10, after the banknote entering sensor senses the entering of the banknote bundle into the conveyor belt and sends the collected information to the controller, the controller controls the third drive mechanism 132 to act to move the banknote bundle closer to the stopper 131 and align the banknote bundle, so that the banknote bundle can be positioned for the first time. After the stopper 131 has been retracted, the fourth drive mechanism 152 drives the banknote stirring plate 151 to push the banknote bundles to be in contact with the banknote stirring plate 151 and align the banknote bundle, so that the banknote bundle can be positioned for the second time. After the banknote bundle has been aligned, the stamping position sensor sends the collected information to the controller, and the controller controls the fifth drive mechanism 162 to act to press the banknote bundle tight. After the banknote bundle has been pressed tight, the controller controls the second drive mechanism 122 to stamp the banknote bundle. In this way, the control is more precise, to secure the movement accuracy of each step, and to make the operation more efficient.

Figure 10:
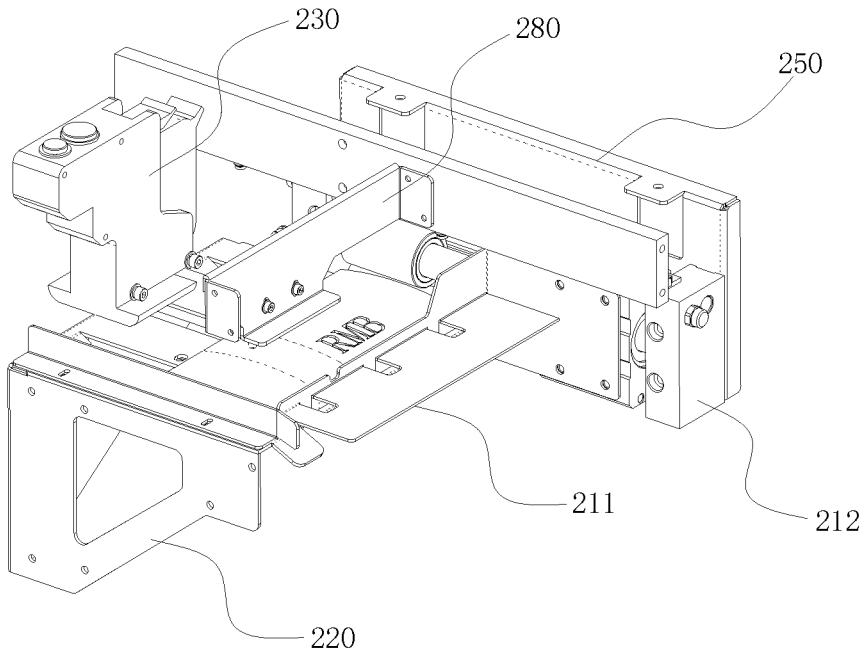
FIG. 10 is an assembly diagram illustrating a mounting bracket and a banknote-pushing mechanism according to an embodiment of the present disclosure.
Figure 11:
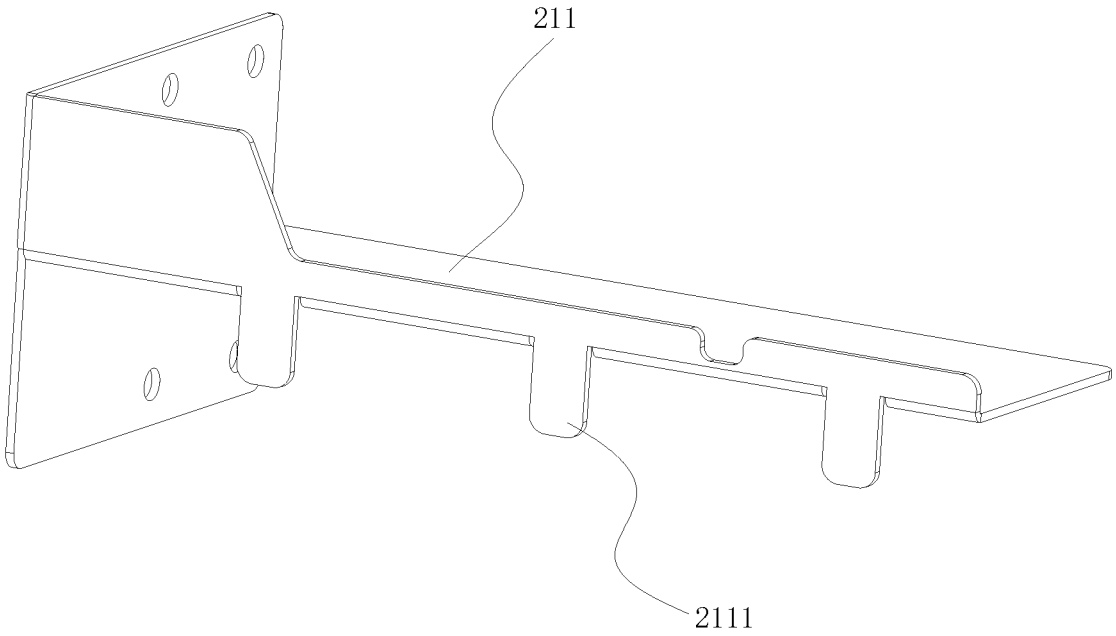
FIG. 11 is a structural schematic diagram illustrating a banknote-pushing plate according to an embodiment of the present disclosure.

As shown in FIGS. 10 and 11, the banknote-pushing plate 211 is provided with at least one protuberance 2111 protruding towards a side with the banknote-supporting platform 220, and the banknote-supporting platform 220 is provided with a gap 223 cooperated with the protuberance 2111. The cooperation of the protuberance 2111 and the gap 223 prevents the presence of any space between the banknote-pushing plate 211 and the banknote-supporting platform 220, to secure that the banknote bundle can be pushed to the code sprayer 230 completely.

In this embodiment, the banknote-pushing plate 211 is provided with three protuberances 2111, and the banknote-supporting platform 220 is provided with three gaps 223. The banknote-pushing plate 211 may also be proved with more than one protuberance 2111 according to actual needs, and the number of the gaps 223 on the banknote-supporting platform 220 may be not less than the number of the protuberances 2111.

As shown in FIGS. 1 to 4, and FIG. 9, the banknote-bundle code-spraying device 20 also includes a mounting bracket 250 positioned directly above the banknote-supporting platform 220, a mounting platform 260 positioned directly under the banknote-supporting platform 220 and a seventh drive mechanism 270 adapted to drive the banknote-supporting platform 220 to move up and down. The mounting bracket 250 is provided with the banknote-pushing mechanism 210 and the code sprayer 230. The mounting platform 260 is provided with the conveyor belt 100 and a blocking rod 241. The banknote-supporting platform 220 is provided with an opening hole 224 cooperated with the blocking rod 241. When the banknote-supporting platform 220 is positioned on the mounting platform 260, the blocking rod 241 protrudes through the opening hole 224 precisely, and when the conveyor belt 110 bring the banknote bundles into the banknote-supporting platform 220 and the banknote bundle is moved to the position of the blocking rod 131 with the conveyor belt 110, the blocking rod align the banknote bundle, securing the accuracy of the code-spraying position on the banknote bundle. The conveyor belt 110 stops moving, the seventh drive mechanism 270 drives the banknote-supporting platform 220 to move upwards. When the banknote-supporting platform 220 moves to a position where the protuberance 2111 of the banknote-pushing plate is inserted into the gap 223 of the banknote-supporting platform 220, the banknote-supporting platform 220 stops moving, and the first drive mechanism 212 drives the banknote-pushing plate to move the banknote bundle towards the side with the banknote outlet 222. The whole structure is designed flexibly and intelligently, using the cooperation of the gap 223 of the banknote-supporting platform 220 with the conveyor belt 110 and the banknote-pushing plate 211 sufficiently to prevent interference between the conveyor belt 110 and the banknote-pushing plate 211 during operation.

In this embodiment, the banknote-supporting platform 220 is provided with four opening holes 224, and the banknote blocking mechanism 240 is provided with four blocking rods 241. However, in another embodiment there may be only one opening hole 224 and only one blocking rod 241 according to actual needs.

Figure 2:
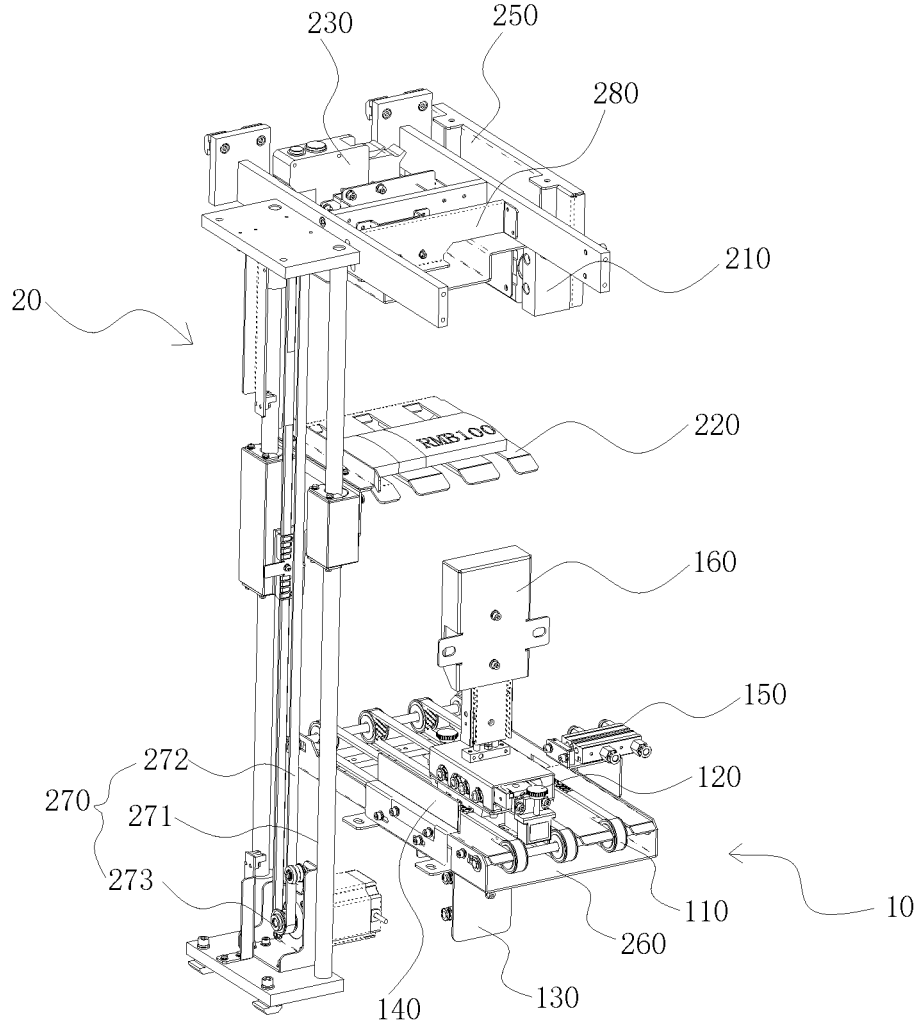
FIG. 2 is a schematic diagram illustrating a second operating state of the device for banknote-bundle stamping and code-spraying according to the embodiment of the present disclosure.
Figure 3:
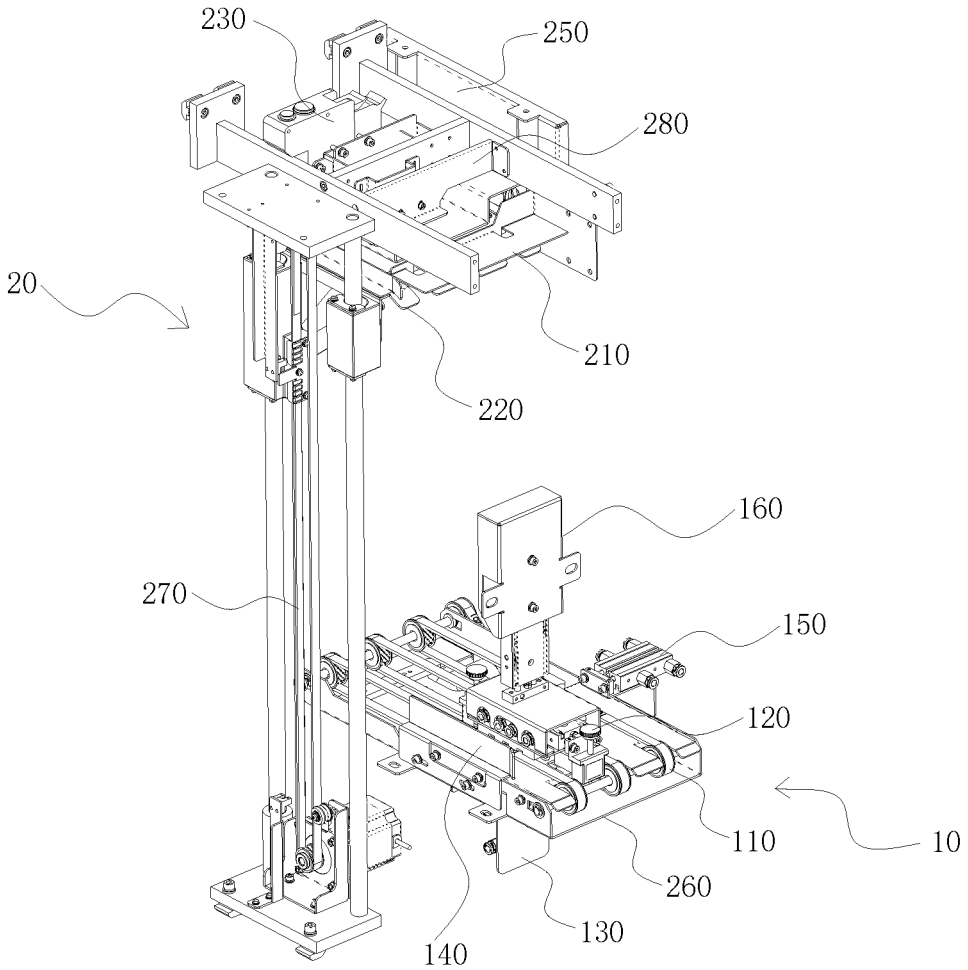
FIG. 3 is a schematic diagram illustrating a third operating state of the device for banknote-bundle stamping and code-spraying according to the embodiment of the present disclosure.
Figure 4:
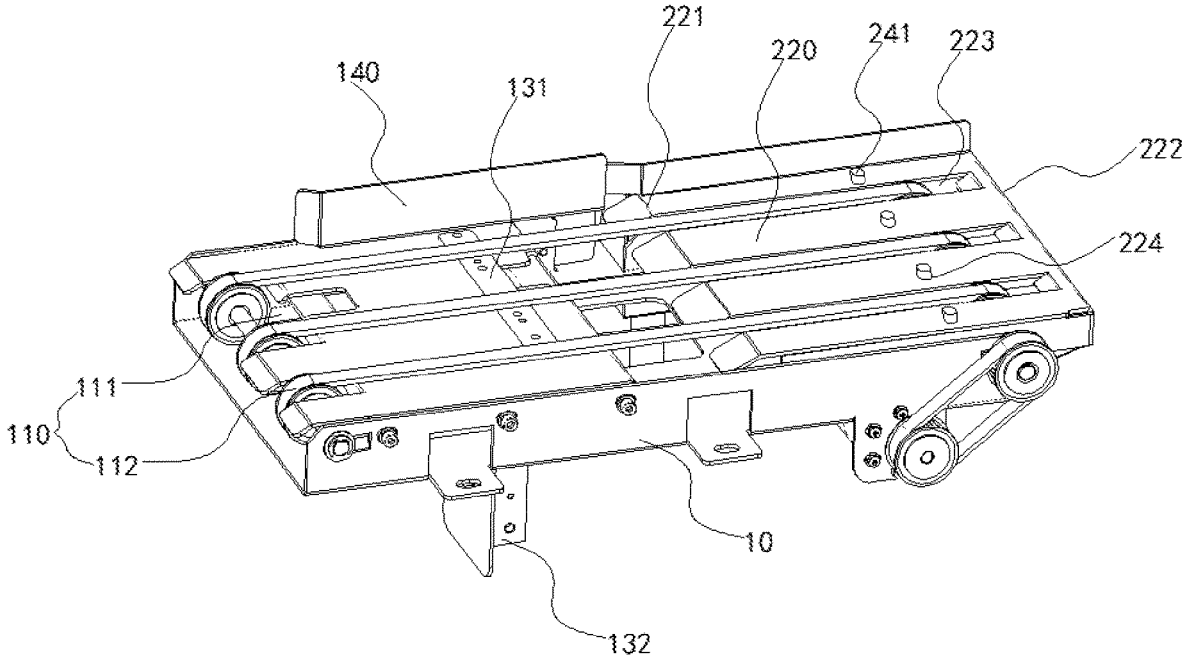
FIG. 4 is a structural schematic diagram illustrating a conveyor belt and a banknote-supporting platform according to an embodiment of the present disclosure.
Figure 5:
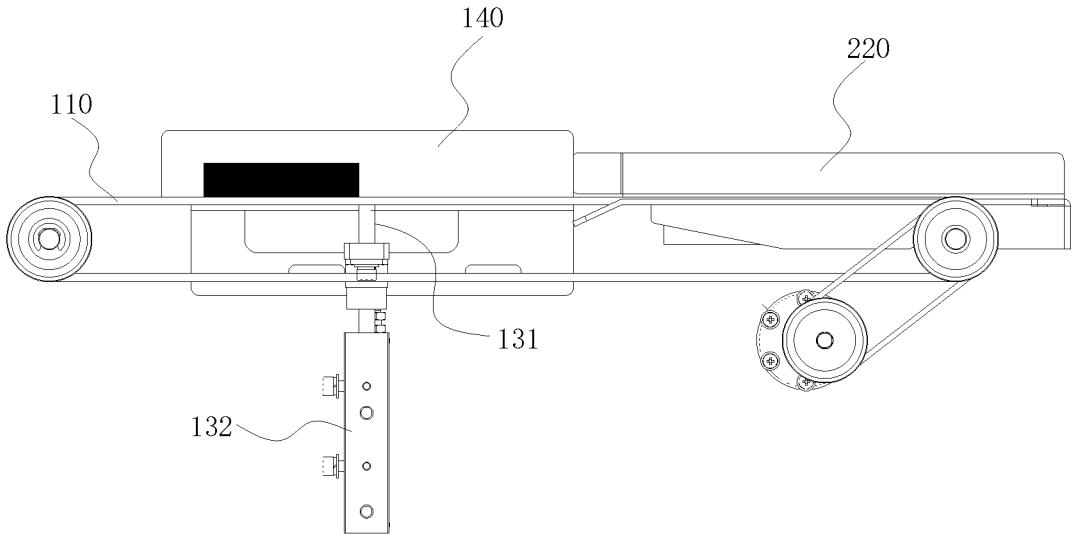
FIG. 5 is a schematic diagram illustrating a first operating state of a banknote blocking mechanism according to an embodiment of the present disclosure.
Figure 6:
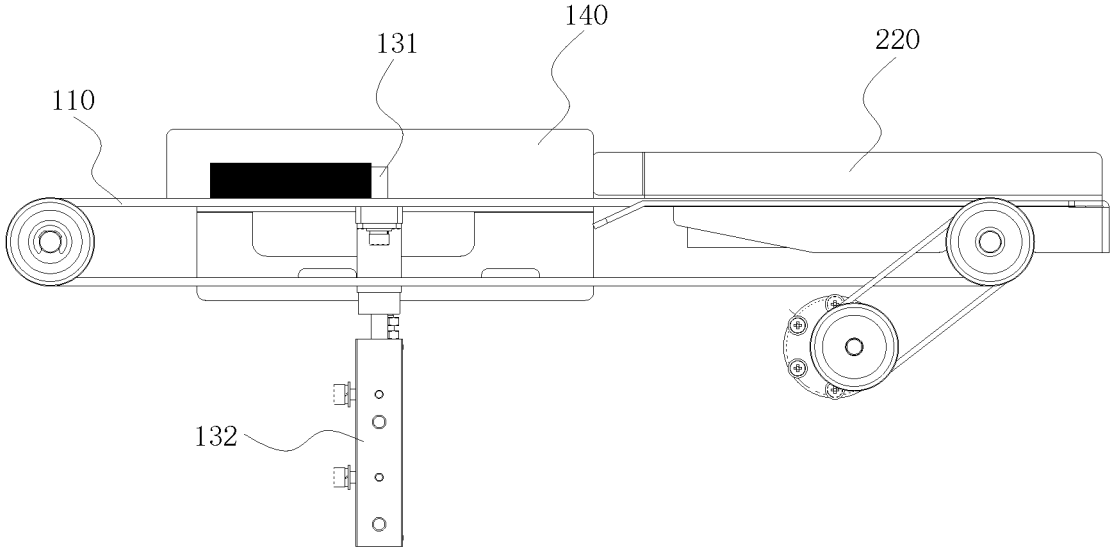
FIG. 6 is a schematic diagram illustrating a second operating state of the banknote blocking mechanism according to the embodiment of the present disclosure.

As shown in FIGS. 1 to 3, the seventh drive mechanism 270 includes a lifting guide rod 271 slidably connected to the banknote-supporting platform 220, a lifting belt 272 arranged in a vertical direction and connected to the banknote-supporting platform 220, and a driving wheel 273 adapted to drive the lifting belt 272 to rotate. The banknote-supporting platform 220 is driven to move up and down with the lifting belt 272, and the lifting guide rod 271 is slidably connected to the banknote-supporting platform 220, so that it allows the banknote-supporting platform 220 to be more stable during the process of the up-down movement.

As shown in FIGS. 1 and 10, the banknote-bundle code-spraying device 20 also includes a banknote-supporting platform upper limit sensor 280 and a banknote-supporting platform lower limit sensor (not shown) electrically connected to the controller. The banknote-supporting platform upper limit sensor 280 is fastened to the mounting bracket 250. The controller is also electrically connected to a sixth drive mechanism and a seventh drive mechanism 270. The code sprayer 230 is provided with a code-spraying sensor (not shown). When the banknote-supporting platform lower limit sensor detects the banknote-supporting platform 220, the banknote-supporting platform 220 is located on the mounting platform 260, and the controller controls the sixth drive mechanism to drive the blocking rod 241 to extend out of the banknote-supporting platform 220. When the banknote bundle enters the banknote-supporting platform 220 with the conveyor belt, the blocking rod 241 is retracted after the banknote bundle being aligned, and the controller controls the seventh drive mechanism 270 to drive the banknote-supporting platform 220 to move upwards. When the banknote-supporting platform upper limit sensor 280 detects the banknote-supporting platform 220, the protuberance 2111 of the banknote-pushing plate 211 is inserted into the gap 223 of the banknote-supporting platform 220, the controller controls the first drive mechanism 212 to drive the banknote-pushing plate 211 to push the banknote bundle to move towards the side with banknote outlet 222. In the process of the banknote bundle passing through the code sprayer 230, when the code-spraying sensor detects the banknote bundle, the code sprayer 230 prints a label on the banknote bundle automatically, so as to make the control of the code-spraying device 20 more precise, securing the movement accuracy of each step, which further improves the operation efficiency.

In this embodiment, the label printed by the code sprayer 230 is a bar code or QR code. The label printed by the code sprayer 230 may also be performed in other forms according to actual needs.

The operation process of the device for banknote-bundle stamping and code-spraying is as follow. When the banknote entering sensor has detected that a banknote bundle enters into a conveying channel, the conveyor belt 110 is activated, and the blocking mechanism 130 extend outwards. After a predefined period, the banknote bundle arrives at the stopper 131, the conveyor belt 110 stop running, and the stopper 131 is retracted. The banknote stirring mechanism 150 acts to push the banknote bundle towards the banknote stirring baffle 140 so as to align the banknote bundle. The banknote stirring mechanism 150 is retracted, the banknote pressing mechanism 160 acts to press the banknote bundles tight, and the stamping mechanism 120 acts to stamp both sides of the bundling band of the banknote bundle. The stamping mechanism 120 is retracted, the banknote pressing mechanism 160 is retracted, and the conveyor belt 110 is activated to convey the banknote bundles to the banknote-supporting platform 220 until being aligned to the blocking rod 241. The banknote-supporting platform 220 moves upwards, and the banknote-supporting platform 220 stops moving after the banknote-supporting platform upper limit sensor 280 being activated. The banknote-pushing mechanism 210 acts to push the banknote bundle towards the banknote outlet 222, and when the banknote bundle passes through the code sprayer 230, the code sprayer 230 prints a bar code or the QR code on the bundling band of the banknote bundle.

In this embodiment, each of the first drive mechanism 212, the second drive mechanism 122, the third drive mechanism 132, the fourth drive mechanism 152, the fifth drive mechanism 162, the sixth drive mechanism and the seventh drive mechanism 270 uses a cylinder to perform the driving action. In another embodiment, each of the first drive mechanism 212, the second drive mechanism 122, the third drive mechanism 132, the fourth drive mechanism 152, the fifth drive mechanism 162, the sixth drive mechanism and the seventh drive mechanism 270 may use other manners to perform the driving action according to actual needs.

Figure 12:
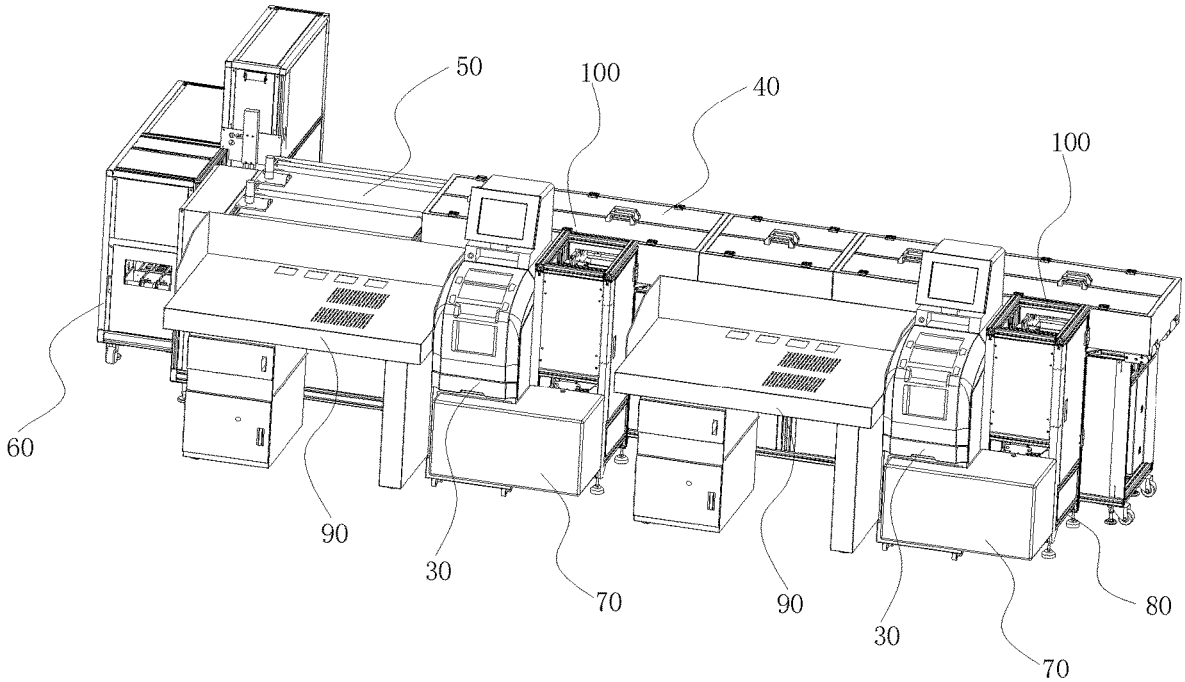
FIG. 12 is a structural schematic diagram illustrating a banknote-sorting production line according to an embodiment of the present disclosure.

As shown in FIG. 12, the present disclosure further provides a banknote-sorting production line including a sorting and bundling integrated machine 30, a device for banknote-bundle stamping and code-spraying, a conveyor main line 40, a palletizer 50 and a plastic packaging machine 60 connected cooperatively and sequentially. The conveyor main line 40 is provided with a first code-scanning mechanism (not shown) adapted to identify stamped and printed labels. The plastic packaging machine 60 is provided with a printing mechanism and a second code-scanning mechanism (not shown) adapted to identify the stamped and printed labels.

The sorting and bundling integrated machine 30 may sort banknotes into damaged banknotes, banknotes for ATMs, circulating banknotes, suspicious banknotes and such like, and bundle a specified number of banknotes according to the configuration. The bundled banknote bundles may be delivered to a conveyor belt 110. The banknote bundles may be conveyed to the conveyor main line 40 after being stamped and printed with the device for banknote-bundle stamping and code-spraying. The first code-scanning mechanism may scan the stamped and printed labels printed by the code sprayer 230 into the system during the conveying process of the conveyor main line 40. The conveyor main line 40 may convey the banknote bundles to the palletizer 50 which palletizes a specified number of the banknote bundles and transfers the banknote bundles to the plastic packaging machine 60. During plastic packaging for a bale of banknotes by the plastic packaging machine 60, the second code-scanning mechanism of the plastic packaging machine 60 may scan the printed labels on each bundle of banknotes of the bale of banknotes, and generate a label according to the scanning results to print on the label of the banknote bale. It is ultimately possible to find information such like heading numbers of a whole banknote bale or one certain banknote by identifying the labels on the banknote bales and find a sorting worker by whom the banknotes are sorted, achieving the precise tracking of information such like heading numbers of banknotes to facilitate to refill ATMs with banknotes.

In this embodiment, the sorting and bundling integrated machine 30 may bundle a specified number of banknotes into a bundle as one hundred banknotes for one bundle. The palletizer 50 may palletize every ten bundles, of which five bundles are rotated by 180°. The sorting and bundling integrated machine 30 and the palletizer 50 may also be configured in other parameters according to actual needs, and the first code-scanning mechanism may also be provided on the palletizer 50 according to actual needs so that the palletizer 50 palletizes the banknote bundles in turn after scanning the labels on the banknote bundles.

As shown in FIG. 12, there is also a banknote outgoing line 70 connected between the sorting and bundling integrated machine 30 and the device for banknote-bundle stamping and code-spraying. The device for banknote-bundle stamping and code-spraying is fastened to the pedestal 80 of the banknote-sorting production line through a frame 100.

As shown in FIG. 12, one side of the banknote-sorting production line is also provided with an environmental worktable 90 in the conveying direction of the conveyor main line 40. The environmental worktable 90 is an operational platform for a sorting worker, having the function of absorbing dust that the dust generated by the banknotes can be absorbed into the inside of the table through dust absorbing pores and be filtered.

What is claimed is:

1. A device for banknote-bundle stamping and code-spraying, comprising a banknote-bundle stamping device, a banknote-bundle code-spraying device and a banknote-supporting platform provided with a banknote inlet and a banknote outlet, wherein the banknote-bundle stamping device comprises a conveyor belt and a stamping mechanism positioned above the conveyor belt, the banknote-bundle code-spraying device comprises a banknote-pushing mechanism and a code sprayer positioned above the banknote-supporting platform, a side of the banknote-supporting platform adjacent to the banknote inlet is provided with a gap matching a shape of the conveyor belt, an outlet end of the conveyor belt extends into the gap, the banknote-pushing mechanism comprises a banknote-pushing plate and a first drive mechanism adapted to drive the banknote-pushing plate to reciprocate in a direction from the banknote inlet to the banknote outlet, and the stamping mechanism comprises a stamp and a second drive mechanism adapted to drive the stamp to move.

2. The device for banknote-bundle stamping and code-spraying according to claim 1, wherein the banknote-bundle code-spraying device further comprises a blocking mechanism positioned under the conveyor belt, the blocking mechanism comprises a stopper and a third drive mechanism adapted to drive the stopper to extend out of the conveyor belt, and the conveyor belt is provided with an opening cooperated with the stopper.

3. The device for banknote-bundle stamping and code-spraying according to claim 2, wherein the banknote-bundle stamping device further comprises a banknote stirring baffle and a banknote stirring mechanism positioned on both sides of the conveyor belt respectively in a conveying direction, and the banknote stirring mechanism comprises a banknote stirring plate and a fourth drive mechanism adapted to drive the banknote stirring plate to move towards the banknote stirring baffle.

4. The device for banknote-bundle stamping and code-spraying according to claim 1, wherein the banknote-bundle stamping device further comprises a banknote pressing mechanism positioned above the conveyor belt, and the banknote pressing mechanism comprises a pressing plate and a fifth drive mechanism adapted to drive the pressing plate to move up and down.

5. The device for banknote-bundle stamping and code-spraying according to claim 4, wherein the stamping mechanism and the pressing plate are fastened to a movable end of the fifth drive mechanism, the stamping mechanism comprises two stamps arranged symmetrically, and moving tracks of the two stamps on the banknote-bundle stamping device are parallel to a conveying direction of the conveyor belt.

6. The device for banknote-bundle stamping and code-spraying according to claim 1, wherein the banknote-pushing plate is provided with at least one protuberance protruding towards the banknote-supporting platform Gide, and the protuberance cooperates with the gap.

7. The device for banknote-bundle stamping and code-spraying according to claim 1, further comprising a mounting bracket positioned directly above the banknote-supporting platform, a mounting platform positioned directly under the banknote-supporting platform and a seventh drive mechanism adapted to drive the banknote-supporting platform to move up and down, the mounting bracket is provided with the banknote-pushing mechanism and the code sprayer, and the mounting platform is provided with the conveyor belt.

8. The device for banknote-bundle stamping and code-spraying according to claim 7, wherein the mounting platform is provided with a blocking rod, and the banknote-supporting platform is provided with an opening hole cooperated with the blocking rod.

9. The device for banknote-bundle stamping and code-spraying according to claim 7, wherein the seventh drive mechanism comprises a lifting guide rod slidably connected to the banknote-supporting platform, a lifting belt arranged in a vertical direction and connected to the banknote-supporting platform, and a driving wheel adapted to drive the lifting belt to rotate.

10. A banknote-sorting production line, comprising a sorting and bundling integrated machine, the device for banknote-bundle stamping and code-spraying according to any one of claims 1 to 9, a conveyor main line, a palletizer and a plastic packaging machine connected cooperatively and sequentially, wherein the conveyor main line is provided with a first code-scanning mechanism adapted to identify stamped and printed labels, and the plastic packaging machine is provided with a printing mechanism and a second code-scanning mechanism adapted to identify the stamped and printed labels.

* * * * *